US005142987A

United States Patent [19]

Freymuth et al.

[11] Patent Number: 5,142,987

[45] Date of Patent: Sep. 1, 1992

[54] AUTOMATIC ANCHOR APPLICATOR

[75] Inventors: Donald C. Freymuth, Racine; Jeffrey S. Hon, Waterford; Dale K. Lange, Racine; Gerald J. Paulus, Racine; Thomas F. Petrykowski, Racine; Robert L. Turner, Racine, all of Wis.

[73] Assignee: Racine Railroad Products, Inc., Racine, Wis.

[21] Appl. No.: 573,234

[22] Filed: Aug. 27, 1990

[51] Int. Cl.[5] ..... E01B 29/32

[52] U.S. Cl. ..... 104/17.2

[58] Field of Search ..... 104/17.2, 2

[56] References Cited

U.S. PATENT DOCUMENTS

| | | | |
|---|---|---|---|
| 3,121,400 | 2/1964 | Giebel et al. | 104/17.2 |
| 3,127,847 | 4/1964 | Sivon | 104/17.2 |
| 3,272,148 | 9/1966 | McIlrath | 104/17.2 |
| 3,326,137 | 6/1967 | McTighe et al. | 104/17.2 |
| 3,438,335 | 4/1969 | McIlrath | 104/17.2 |
| 3,585,936 | 6/1971 | Fester | 104/17.2 |
| 3,745,931 | 7/1973 | Izdebski | 104/17.2 |
| 3,766,860 | 10/1973 | McIlrath | 104/17.2 |
| 4,320,707 | 3/1982 | McIlrath | 104/17.2 |
| 4,479,440 | 10/1984 | Burr et al. | 104/17.2 |

*Primary Examiner*—Robert J. Oberleitner
*Assistant Examiner*—Kevin D. Rutherford
*Attorney, Agent, or Firm*—Wood, Phillips, Van Santen, Hoffman & Ertel

[57] ABSTRACT

An automatic anchor applicator is provided having a frame which mounts a head assembly for vertical movement between a raised travel position and a lowered operative position. The head assembly has an inclined anchor conveyor and a pair of articulated applicator arms for transporting a pair of anchors from a loading station to a position adjacent a rail. Adjuster members are positioned immediately adjacent the pair of anchors at an adjustment station to shift the anchors along the rail into abutting relation with opposite vertical faces of the tie. Relative rotation of the articulated arms resiliently places the positioned anchors into positive engagement with the rail.

24 Claims, 7 Drawing Sheets

AUTOMATIC ANCHOR APPLICATOR

FIELD OF THE INVENTION

This invention relates to an anchor applicator for positioning and securing rail-mounted anchors and, more particularly, to an apparatus for automatically delivering a pair of anchors to a rail, positioning the anchors in abutting relation with opposite faces of a tie, and placing the anchors into positive engagement with the rail.

BACKGROUND OF THE INVENTION

A rail anchor clamps onto a railway rail and is positioned to abut a vertical face of a tie whereby there is resistance to longitudinal movement of a rail relative to the supporting tie.

For many years, there have been machines for setting, applying, and removing rail anchors. These procedures involve both placing anchors in close abutting relation with opposite vertical faces of a tie when installing the anchors and/or tie, as well as shifting the anchors lengthwise of the tie so that a tie remover can longitudinally withdraw the tie from beneath the rail to replace a tie. Equipment for spreading anchors is shown in Quella U.S. Pat. No. 4,890,558. Adjusting anchors into tie-abutting positions can be accomplished with a device such as that shown in Miller U.S. Pat. No. 3,117,531. Equipment for positioning and applying anchors is generally shown, with significant limitations, in McIlrath U.S. Pat. Nos. 3,272,148 and 3,438,707.

McIlrath discloses an apparatus for securing anchors onto rails, but requires that the anchors be manually positioned adjacent the rail for subsequent adjustment and engagement with the rail. With this type of arrangement, either an additional laborer is required to run ahead of the apparatus to pre-position the anchors, or an individual operator must continuously mount and dismount the apparatus to position the anchors himself. In the typical situation where several miles of track are being maintained, such alternatives pose overwhelming inefficiencies in completing repairs.

Additionally, when clamping an anchor onto a rail, a lateral force is developed which is reacted by the applicator apparatus, tending to force the apparatus laterally off of the rails. McIlrath proposes one solution to this problem as a fixed arm which engages the rail prior to securing the anchor. This approach requires that at every tie the stabilizing arm be actuated and retracted to effectively maintain the position of the apparatus on the rails. This increases the complexity of operation of the apparatus as well as increasing the energy consumption and operating expenses of the apparatus.

An automatic anchor applicator to automatically deliver a pair of anchors to a rail, align the anchors in abutting relation with opposite faces of the tie, and place the anchors into positive engagement with the rail would contribute to further mechanization of the operations required in railway track installation and maintenance programs.

SUMMARY OF THE INVENTION

An object, therefore, of the invention, is to provide a new and improved anchor applicator which solves the above problems and satisfies the stated needs.

In the exemplary embodiment of the invention, an automatic anchor applicator includes a frame which mounts a head assembly for vertical movement between a raised travel position and a lowered operative position. The head assembly has an inclined anchor conveyor and a pair of articulated applicator arms for transporting a pair of anchors from a loading station to a position adjacent a rail. Adjuster members are positioned immediately adjacent the pair of anchors at an adjustment station and shift the anchors along the rail into abutting relation with opposite vertical faces of the tie. Relative rotation of the links of the articulated arms resiliently places the positioned anchors into positive engagement with the rail.

Each applicator arm has a pair of pivotally interconnected links, with a hydraulic actuator interconnecting a first one of the links with the head assembly. The actuator is controlled for rotating the arm relative to the head assembly to transport an anchor supported thereon toward the rail. A second actuator drivingly interconnects the first link with the other of the links. Activation of the second actuator results in the rotation of the second link relative to the first link for resiliently placing an anchor into positive engagement with the rail.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE INVENTION

Figure 1:
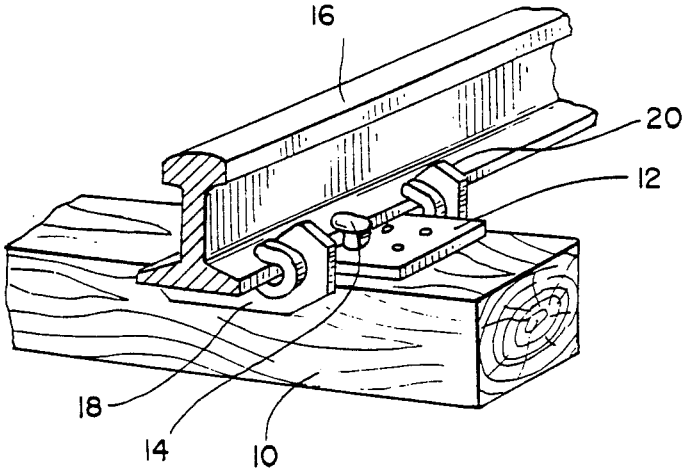
FIG. 1 is a fragmentary perspective view showing a rail, a tie, and a pair of anchors and associated structure.

The present invention is used with railway track structure including a rail and a tie and associated structure including a tie plate and rail-mounted anchors. As best shown in FIG. 1, a tie 10 has a tie plate 12 secured thereto by a rail spike 14. A rail 16 is mounted on the tie plate, and a pair of rail-mounted anchors 18 and 20 abut opposite vertical faces of the tie. It may be understood that there usually is similar associated structure adjacent the opposite end of the tie, and that a series of ties 10 spaced lengthwise of the rail 16 each can have the structure as described in connection with FIG. 1. Ties 10 typically are embedded within a layer of ballast (not shown) comprising rocks and gravel to assist in stabilizing the ties.

The function of the anchor applicator according to the present invention is to automatically deliver a pair of anchors to a position adjacent a rail with a portion of the anchors slidably engaging the rail, positioning the anchors in abutting relation with opposite faces of the tie, and resiliently placing the anchors into positive engagement with the rail. This results in a firm clamping of the tie between the anchors for resisting longitudinal movement of the rail relative to the supporting tie.

Figure 2:
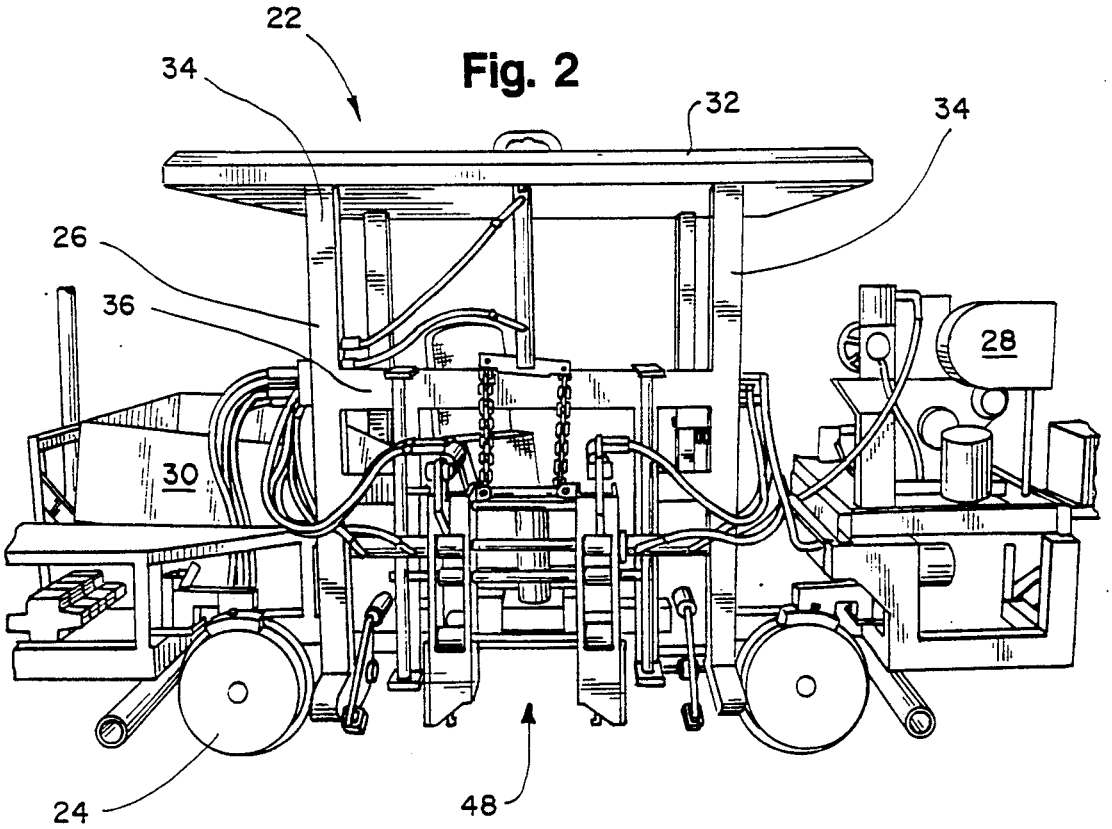
FIG. 2 is a generally side perspective view showing an automatic anchor applicator embodying the features of the present invention.

The anchor applicator, shown in FIG. 2 generally at 22, has a vehicle chassis rotatably mounting rail engaging wheels 24 for lengthwise positioning of the applicator along the track. A rectangular frame 26 is mounted on the chassis between a motor means 28 and an anchor hopper 30 and supports a roof structure 32 at the upper ends of upright frame members 34. Motor means 28 is operable for lengthwise positioning of the applicator along the track as well as activation of the anchor application function, as will be described.

A horizontal brace member 36 rigidly interconnects a pair of upright frame members 34 on a front face of frame 26 at an intermediate height and supports a bracket 38 for mounting a vertically oriented hydraulic cylinder 40. Cylinder 40 has an actuable piston rod 42 which is pivoted to a hoist yoke 44 and chains 46 which depend from the yoke and engage a head assembly 48, whereby hydraulic cylinder 40 is operable to move the head assembly between a raised travel position and a lowered operative position.

Frame 26 mounts a pair of spaced apart rotatable plates **49*a* having guide rollers 49*b* positioned at one end thereof, with a pair of hydraulic cylinders 49*c* pivoted to the plates 49*a* and acting to rotate the plates such that rollers 49*b* embrace one rail during lengthwise movement thereon of the vehicle. The embracing rollers 49*b*** tend to stabilize the vehicle on the rails during performance of the anchor applying function, as will be discussed below.

Head assembly 48 has a pair of spaced apart headplate structures 50 and 52 slidably mounted on a plurality of parallel shafts 54 extending therebetween. A pair of vertically spaced shafts 56 extend between a forward portion of the headplates and include a first shaft **56*a* slidably received within cylindrical spacers 58 interposed between outer plate 50*a* and inner plate 50*b* of headplate 50 and outer plate 52*a* and inner plate 52*b* of headplate 52. Similarly, a second shaft 56*b* extends between upper portions of the headplates and is slidably received within a cylindrical opening in the ends of a pair of upstanding fingers 59** which are sandwiched between the inner and outer plates of the headplates.

Figure 3:
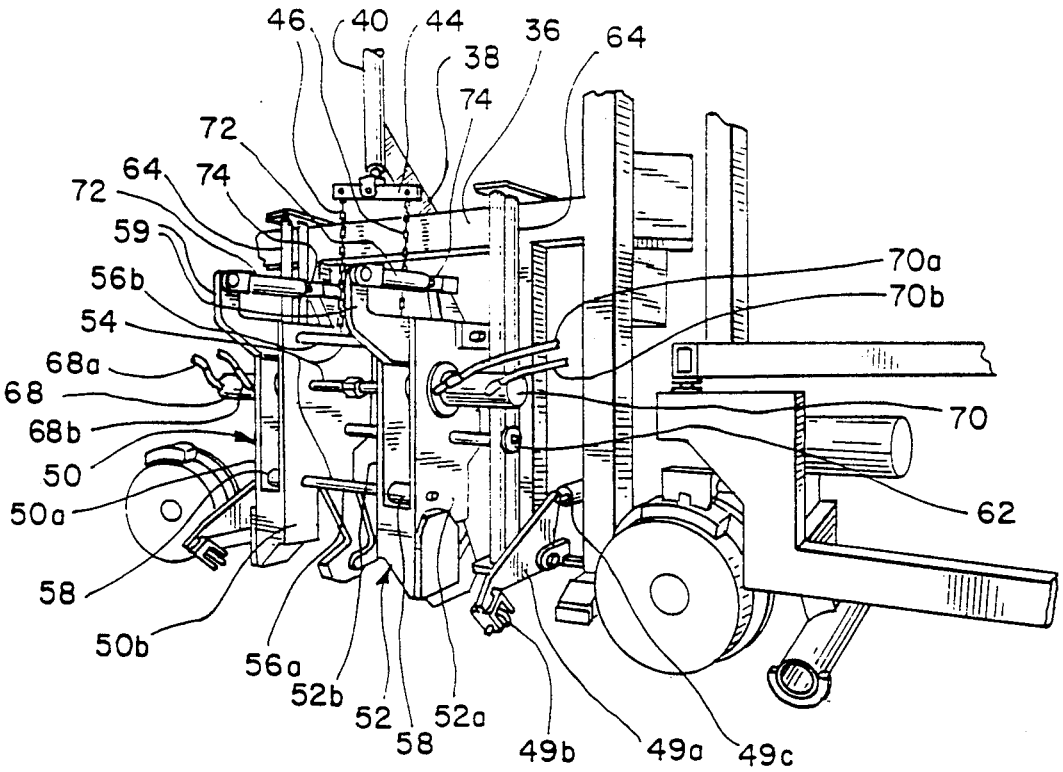
FIG. 3 is a more oblique side perspective view of the automatic anchor applicator of FIG. 2.

A second pair of vertically spaced shafts 60 extend between a rearward portion of the headplates and include an upper shaft **60*a* and a lower shaft 60*b*. Rearward shafts 60 extend parallel to forward shafts 54 and extend beyond the plates 50*a*,52*a* of headplates 50,52, respectively. Each of rearward shafts 60 has a rotatable guide roller 62 (one shown in FIG. 3) mounted to an outer end thereof for engaging oppositely spaced pairs of aligned vertical guide rails 64 formed on frame 26. With this construction, guide rollers 62 coact with guide rails 64 to guide the vertical movement of head assembly 48 induced by actuation of hydraulic cylinder 40**.

Shafts 54 further include a drive shaft 66 comprising a common piston rod for a pair of oppositely spaced hydraulic cylinders 68 and 70 secured to outer headplates **50*a* and 52*a*, respectively. By the control of hydraulic fluid through cylinder lines 68*a* and 68*b* and 70*a* and 70*b*, respectively, the headplate structures 50 and 52 are caused to move toward and away from each other along parallel shafts 56, 58 and 66**.

Fingers 59 are fixedly mounted to headplates 50 and 52 and are pivotally connected at an upstanding end portion to hydraulic cylinders 72. Hydraulic cylinders 72 have actuable piston rods 74 terminating in pivotal connections 76 for engaging a pair of articulated anchor applicator arms 78, which will be described in detail below.

Figure 5:
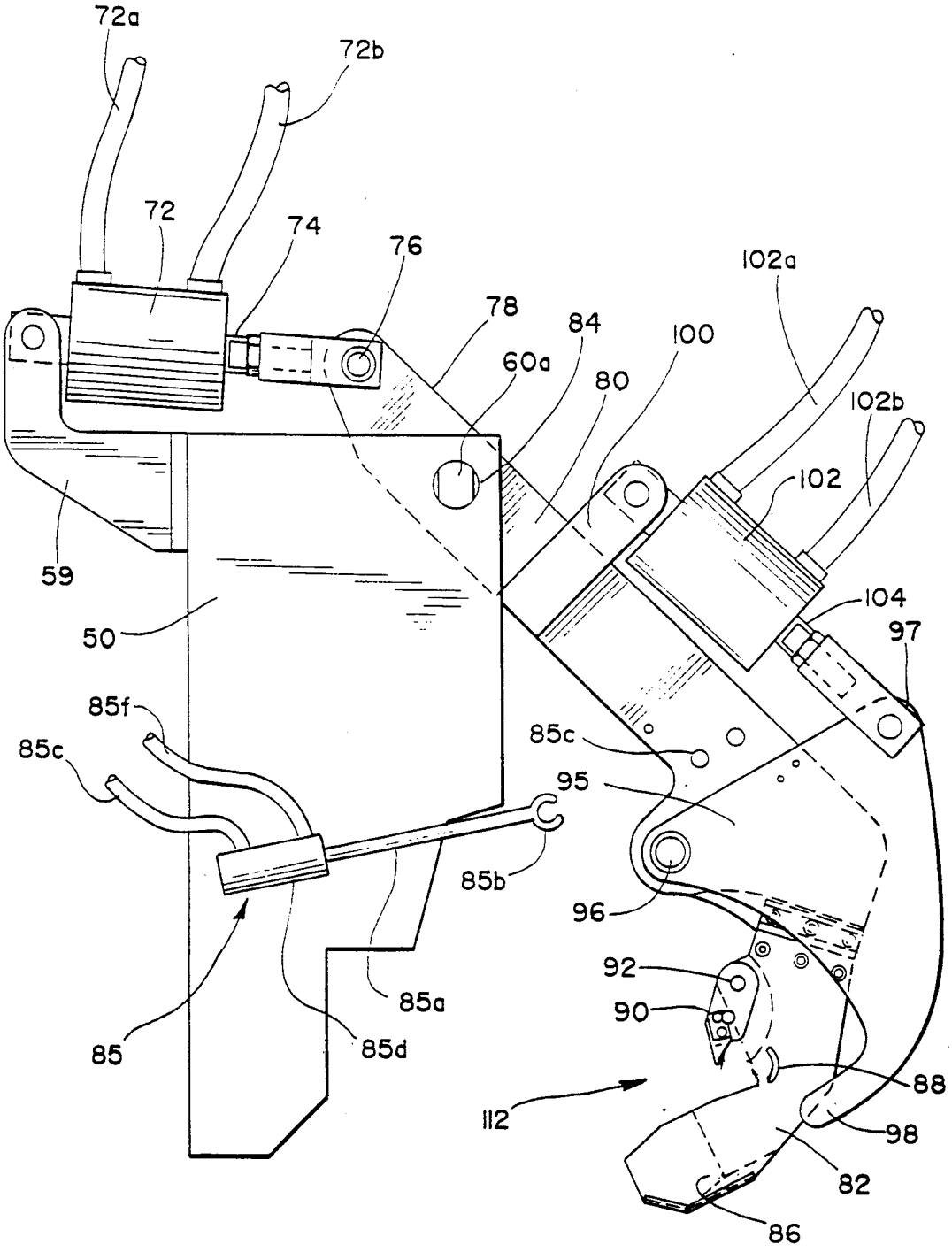
FIG. 5 is a side view of a headplate/applicator arm assembly in a retracted position.

Referring to FIG. 5, articulated arm 78 has an elongated leg 80 terminating in a curved foot portion 82. An aperture 84 extends through leg 80 whereby each of articulated arms 78 may be rotatably mounted on guide roller shaft **60*a*. By the control of hydraulic fluid cylinder 72 through the cylinder lines 72*a* and 72*b*, piston rod 74 may be extended and retracted to pivot applicator arm 78 about shaft 60*a* and thereby move foot 82** toward and away from a corresponding headplate.

Each headplate/applicator arm assembly has a force reaction linkage 85 including an extendable link **85*a* mounted on a headplate with a clasp 85*b* in one end thereof, and with a complementary keeper 85*c* disposed on leg portion 80 of applicator arm 78. Preferably, a hydraulic cylinder 85*d* is controlled through motor lines 85*e* and 85*f* and drives the reaction links between an extended position, wherein clasp 85*b* rigidly engages keeper 85*c*** such that forces applied to the applicator arm are distributed throughout the headplates.

Foot 82 has a laterally opening anchor-receiving recess 86 formed therein (indicated in phantom in FIG. 5) with an arcuate anchor support 88 provided to assist in supporting an anchor carried within recess 86, as will be described. Further, a rotatable latch flipper 90 is drivingly mounted on a hydraulically controlled shaft 92 to engage an anchor received in recess 86 and resting on anchor support 88.

A generally triangular applicator claw 94 is pivoted to applicator arm 78 at a rotatable connection 96 near foot 82 intermediate a heel portion 97 and a projecting toe 98.

A mounting flange 100 projects from articulated arm 78 at a point approximately mid-length on leg 80 and pivotally engages the barrel portion of a hydraulic fluid cylinder 102 extending substantially parallel to leg portion 80. Cylinder 102 mounts an actuable piston rod 104 which is pivotally connected at a distal end 106 to heel portion 97 of applicator claw 94. By controlling hydraulic fluid cylinder 102 through the cylinder lines **102*a* and 102*b*, piston rod 104 may be extended and retracted to pivot applicator claw 94 about pivot 96 on applicator arm 78 and thereby move projecting toe 98 toward and away from anchor receiving recess 86**.

Figure 4:
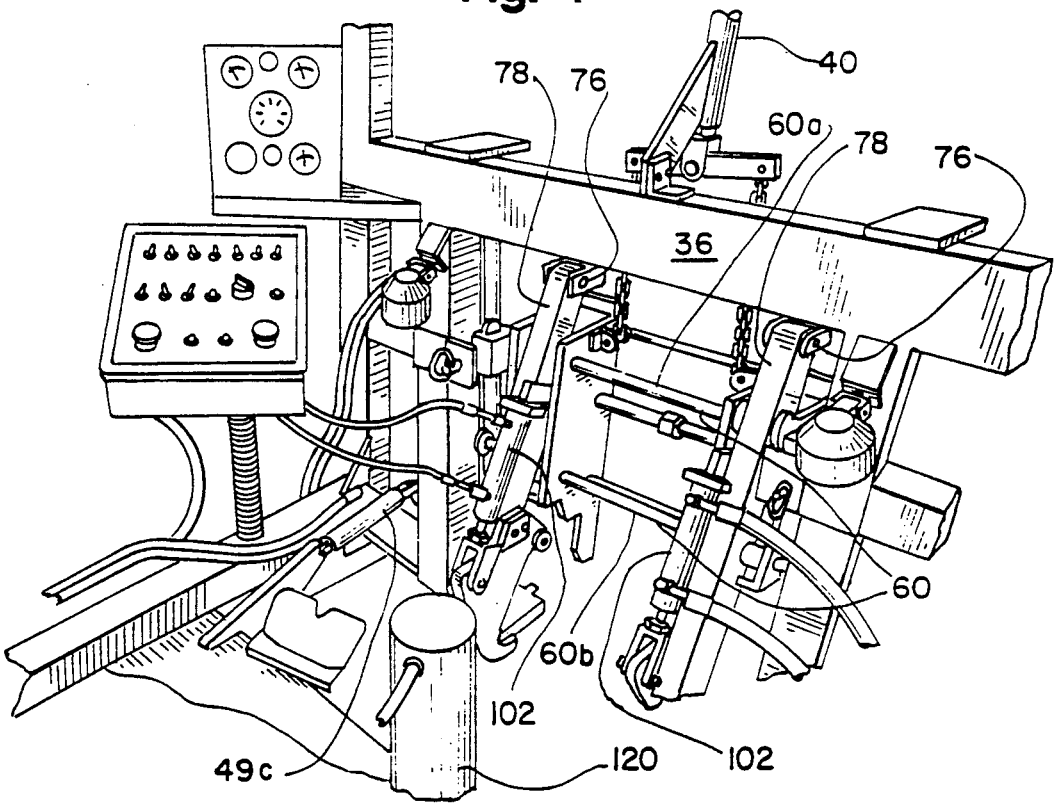
FIG. 4 is a perspective view looking down on the head assembly of the automatic anchor applicator of FIG. 2, with the delivery mechanism not shown.

An anchor delivery mechanism 108 is provided intermediate applicator arms 78 and headplates 50,52 for continuously transporting pairs of anchors sequentially from a load station 110 to a transfer station 112 adjacent the anchor receiving recesses 86 of applicator arms 78. Shown specifically in FIG. 6, delivery mechanism 108 has an inclined track mounted frame 114 which extends from a bottom end 116 adjacent the transfer station 112 upwardly to an upper end 118 in vertical alignment with a frame post 120 and in parallel with applicator arms 78 and headplates 50,52. The orientation of delivery track 114 may best be understood when the above description is taken in conjunction with FIG. 4, wherein depiction of the delivery mechanism has been omitted to enhance the understanding of the structure shown therein.

Delivery track 114 circuitously mounts a drive chain 122 about oppositely spaced idler pulleys 124, 126, a pair of tensioners 128, 130, and a drive sprocket 132. Drive sprocket 132 fixedly engages a hydraulic motor drive shaft 134 whereby energization of the drive shaft results in rotation of sprocket 132 and continuous advancing of drive chain 122 about opposite ends of delivery track 114. A chain mounted carrier 136 is movable along the length of track 114 and has a horizontal support platform 138 extending toward head assembly 48. Horizontal platform 138 supports an anchor transfer assembly 140 for transporting a pair of anchors assembly from upper loading station 110 to lower transfer station 112. A hydraulic motor 142 overlies transfer assembly 140 for purposes to be herein described.

Figure 6:
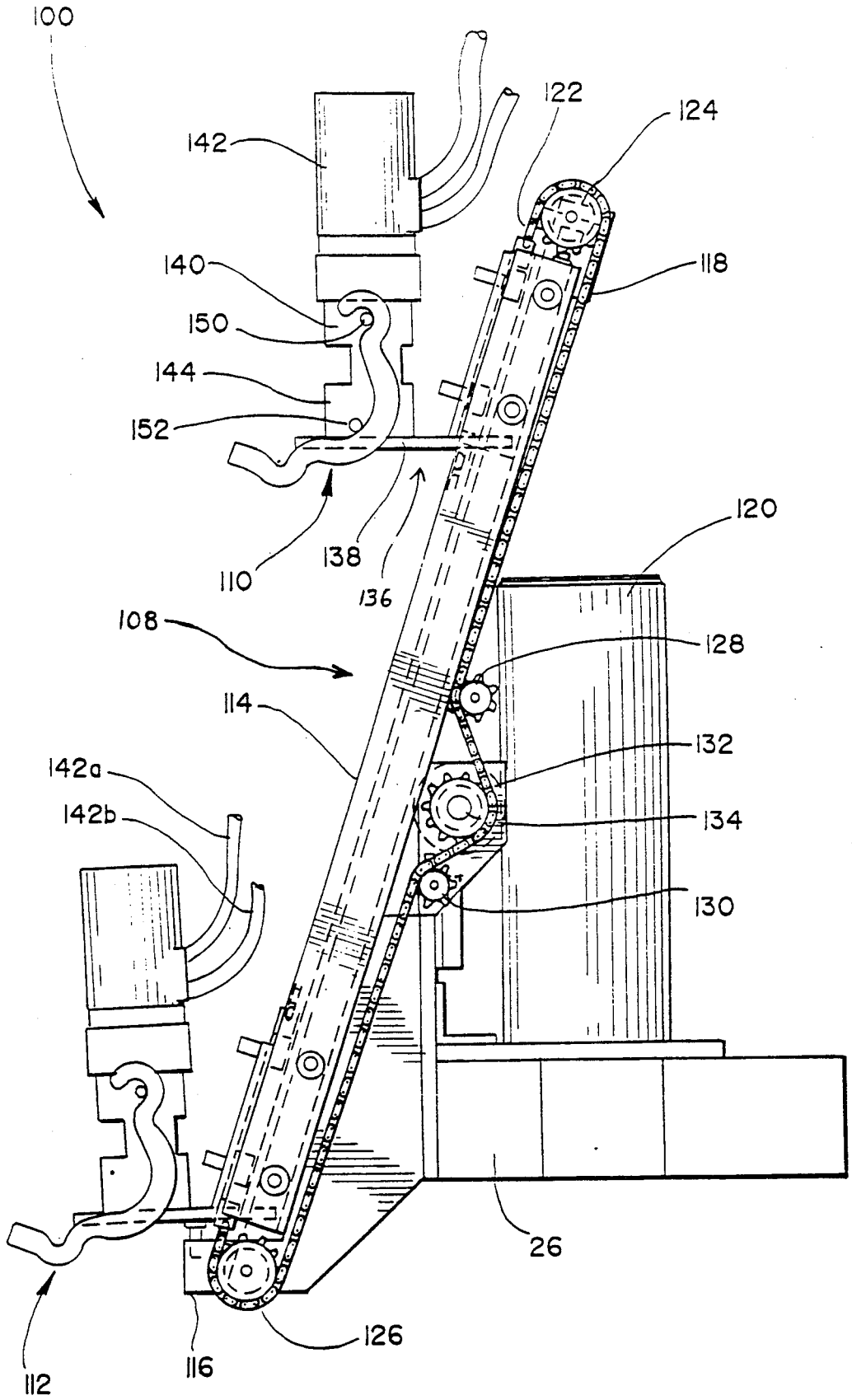
FIG. 6 is a side view of a delivery mechanism in the automatic anchor applicator shown in FIG. 2.
Figure 7:
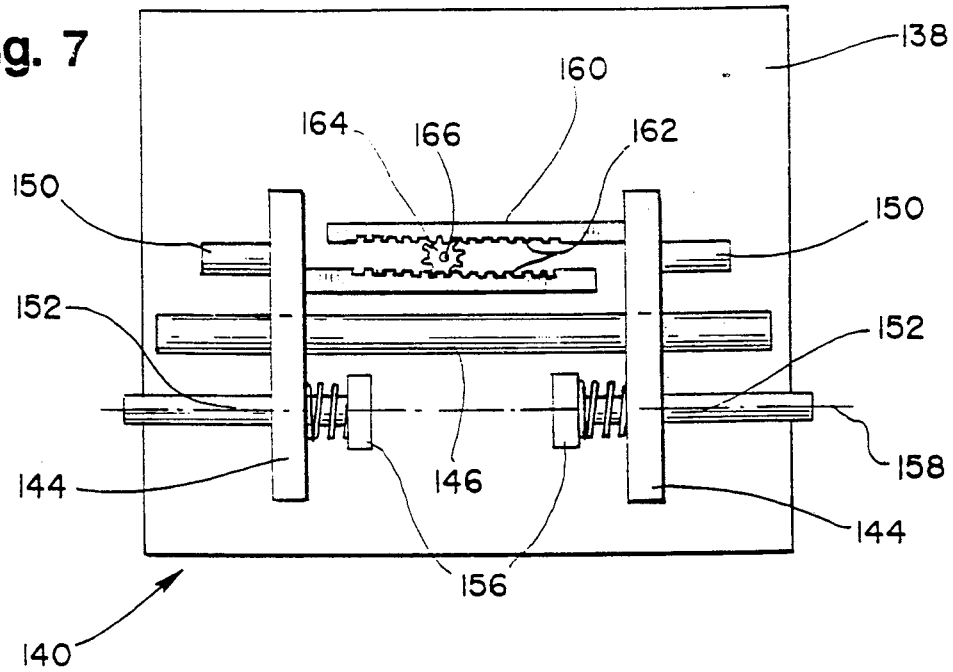
FIG. 7 is a top of view of a transfer assembly positioned on the delivery mechanism shown in FIG. 6.

Referring to FIG. 7, transfer assembly 140 includes a pair of vertical spaced transfer plates 144 slidably mounted on a common shaft 146. Opposite ends of shaft 146 extend outwardly of plates 144 near mounting pegs 150 which support a pair of anchors on the transfer assembly. A second pair of mounting pegs 152 extend oppositely through transfer plates 144 and engage a portion of anchors suspended from pegs 150, as shown in FIG. 6. Pegs 152 have helical springs 154 interconnecting a head portion 156 and an inner face of plates 144 for biased displacement along centerline 158.

Transfer plates 144 have a pair of L-shaped flanges 160 extending inwardly therefrom with a series of gear-engaging teeth 162 being formed along a portion of the flanges. A drive gear 164 is mounted on a motor shaft 166 extending downwardly from hydraulic motor 142 and drivingly engages the teeth 162 of each of flanges 160 on transfer plates 144. By the control of hydraulic motor 142 through motor lines **142*a* and 142*b*, motor shaft 166 and drive gear 164 are rotated in clockwise or counterclockwise directions as indicated by arrows C and D, respectively, to move flanges 160 and thereby transfer plates 144 toward and away from each other along common shaft 146**.

Operation of the automatic anchor applicator may be briefly summarized as follows. The anchor applicator is brought to a desired location along the rails to have the head assembly overlie a tie, with the headplates 50,52 in a raised position and the rollers **49*b* embracing the rail. A pair of rail anchors are manually extracted from the hopper and placed on the mounting pegs of the delivery mechanism at a loading station near the upper end of the inclined track 114. Hydraulic motor shaft 134 then is energized to advance the chain drive and lower the transfer assembly to a transfer station adjacent the lower ends of applicator arms 78**.

Once the transfer assembly has reached the transfer station, hydraulic motor 142 is activated to rotate drive gear 164 in a clockwise direction to spread transfer plates 144. The plates force the anchors oppositely off of the mounting pegs 150 and 152 and into anchor receiving recesses 86 on the adjacent applicator arms. Pegs 152 move with the transfer plates and resiliently retract therebetween once contact is made with the applicator arms. In this way the anchors are guided into proper alignment with the anchor receiving recesses.

Once the anchors are seated in the recesses, motor shaft 92 is activated to rotate flipper latches 90 into engagement with the anchors. Drive gear 164 then is driven in a counterclockwise direction to draw the transfer plates together and withdraw the biased mounting pegs 152 from engagement with the anchors. Latch 90 prevents the disturbance of the anchors during withdrawal of the pegs. Motor shaft 134 then is activated and the transfer assembly is returned to the load station for subsequent loading.

While the delivery mechanism is returning to the load station, a number of other events take place substantially simultaneously. Hydraulic cylinder 40 is activated to begin lowering head assembly 48 toward an adjusting station adjacent the underlying rail. As the head assembly is lowered, hydraulic cylinders 68 and 70 are controlled to move headplates 50 and 52 and articulated applicator arms 78 towards each other and toward opposite faces of the tie. Simultaneously, hydraulic cylinder 72 is actuated to rotate applicator arms 78 about shaft **60*a*** and thereby present the pair of anchors to the rail.

Figure 8:
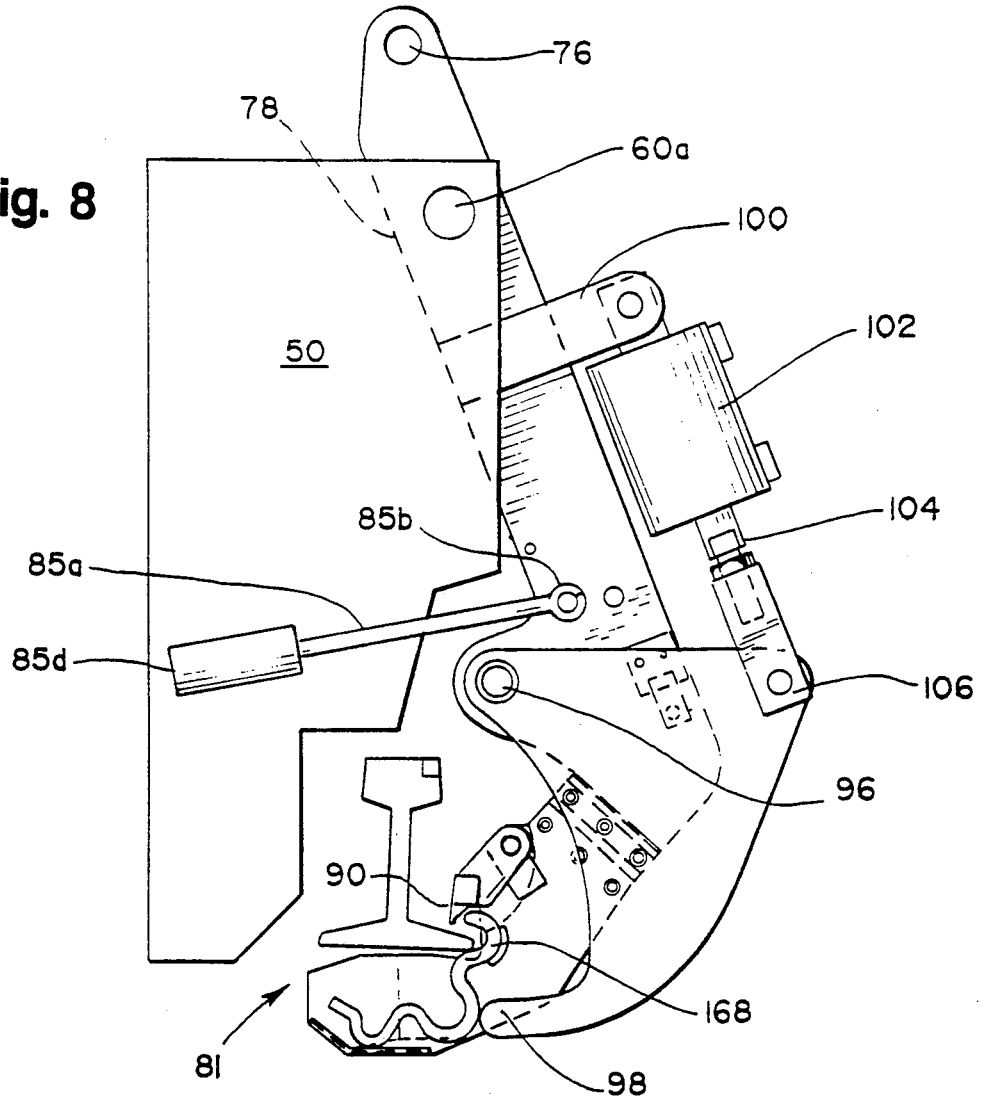
FIG. 8 is a side view of the headplate/applicator arm assembly of FIG. 5 in a first extended position.

Once the head assembly has reached a lowermost position, cylinder 72 is continued to be controlled for rotating the applicator arms until foot portion 80 is positioned in underlying relationship with the rail at an adjustment station 81, as shown in FIG. 8. This rotation results in a first crook portion 168 on the anchor engaging one edge of rail base. At this point, hydraulic cylinders 68 and 70 also are further controlled to move headplates 50 and 52 towards each other. The converging headplates thereby define adjustment means and shift the partially engaged anchors into abutting relation with opposite faces of the tie.

Once the tie is tightly boxed on opposite sides with the anchors and headplates, reaction link **85*a* is extended so that clasp 85*b* engages keeper 85 and rigidifies the headplate/applicator arm assembly. Motor shaft 92 is oppositely actuated to rotate flipper latch 90** away from the anchors to allow the release of the anchors from the applicator arms.

Figure 9:
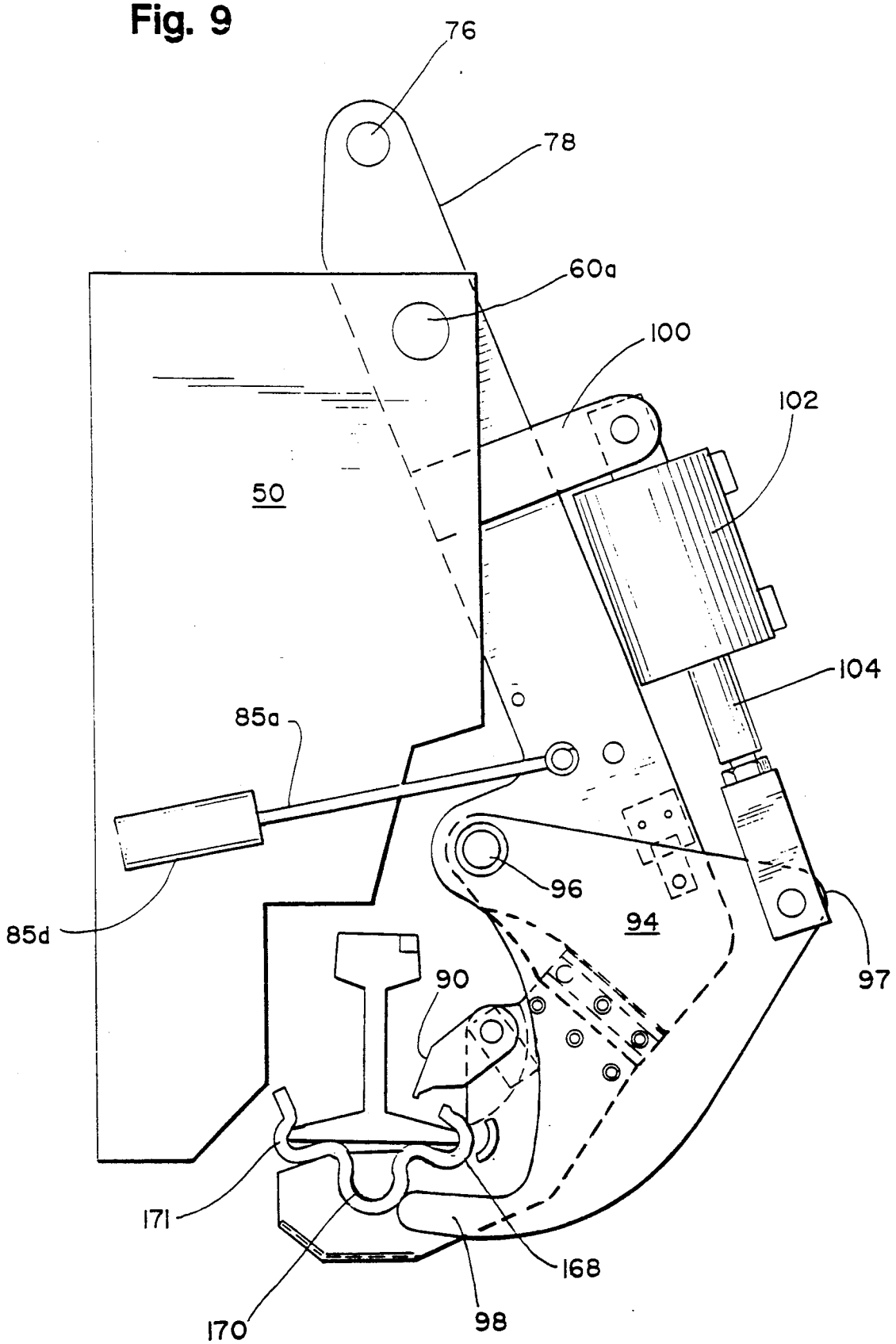
FIG. 9 is a side of the headplate/applicator arm assembly of FIG. 5 in a second extended position.

Next, hydraulic cylinders 102 are actuated to pivot applicator claws 94 and force toe portions 98 into engagement with the anchors (see FIG. 9). Continued extension of piston rod 104 forces the claws against a second crook portion 170 on the anchors to resiliently snap a third crook portion 171 on the anchors into positive engagement with the rail. Due to the substantial lateral forces developed during attachment of the anchor, large reaction forces are applied to the ends of the anchor applicator arms. In order to minimize the resulting bending moments and forces transmitted to the hydraulic cylinders, the reaction links distribute the reaction forces throughout the headplates. As noted, rail embracing rollers **49*b*** oppose the net lateral force reaction and maintain the stability of the vehicle on the rails.

Once anchor application is complete, cylinder **85*d* is controlled to retract reaction link 85*a* and disengage clasp 85*b*, cylinder 102 is controlled to retract piston rod 104 and thereby rotate the applicator claws out of engagement with the anchor, and cylinder 72 is controlled to retract piston rod 74 and rotate the applicator arms away from the rail. Cylinders 68 and 70 are controlled to spread the headplates away from the tie, and cylinder 40** is controlled to raise the head assembly for subsequent transport of the vehicle.

Because of the precision required in automatically transferring a pair of anchors from the delivery mechanism onto the applicator arms, it is essential that the head assembly be completely level and centered on the frame so that the anchor receiving recesses are properly aligned with the transfer assembly. To this end, a plurality of position adjusters are mounted about the apparatus.

Figure 10:
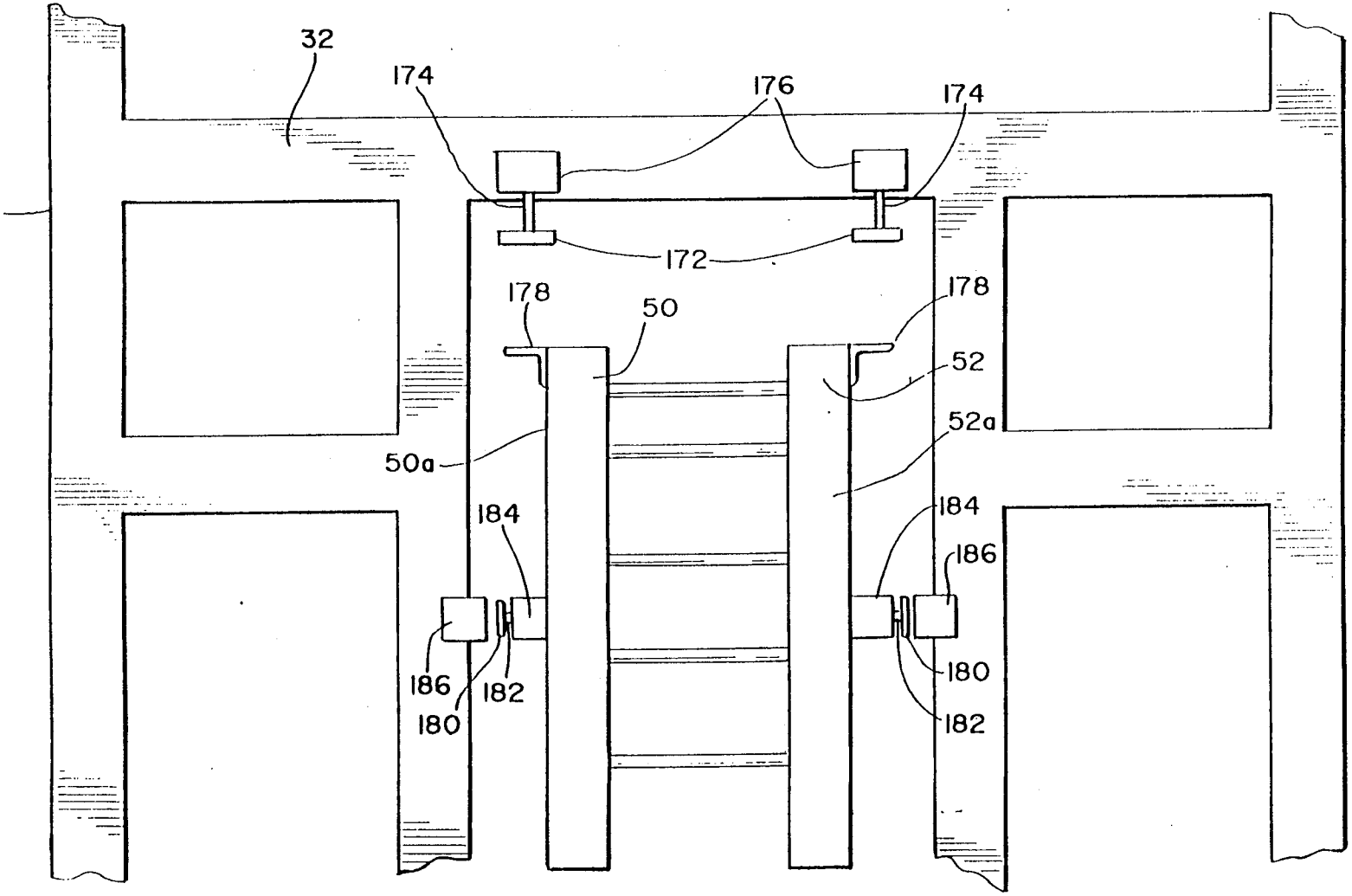
FIG. 10 is a somewhat schematic front view of the applicator frame and illustrating the levelling and centering structure.

FIG. 10 illustrates a pair of vertically extending leveling feet 172 having threaded legs 174 adjustably engaging tubes 176 which are welded to cross brace 32. Complementary stop pads 178 extend from the underlying headplates and contact the feet 172 to assure that the head assembly is raised to a level position.

Analogously, a pair of laterally extending centering feet 180 having threaded legs 182 adjustably engaging horizontal tubes 184 mounted on outer plates 50*a*,52*a* of head assembly 48. Complementary stop pads 186 extend from the frame periphery and contact the feet to assure that the headplates are outwardly spaced such that the head assembly assumes a centered position on the frame.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An apparatus for applying an anchor to a tie-mounted rail, said apparatus comprising:

a frame defining an anchor load station for receiving anchors;

a head assembly movably mounted on the frame for vertical movement toward and away from a tie;

first transport means for moving an anchor from the anchor load station vertically downwardly without vertically moving the head assembly to an anchor transfer station;

second transport means for moving an anchor from the anchor transfer station into a position for adjustment on the rail;

adjuster means for moving the anchor along the rail and into abutment with the tie; and an applicator assembly for placing a positioned anchor into a positive engagement with the rail.

2. The apparatus defined in claim 1 in which the second transport means has retention means for preventing disturbance of anchors transferred thereto.

3. The apparatus defined in claim 1 in which the first transport means has off-loading means for transferring the anchor from the first transport means to the second transport means at the transfer station.

4. The apparatus defined in claim 1 including positioning means for facilitating alignment of the second transport means with the first transport means at the transfer station.

5. The apparatus defined in claim 1 including means at said transfer station for transferring anchors from the first transport means to the second transport means.

6. An apparatus for applying anchors on at least one of a pair of tie-mounted parallel spaced rails, said apparatus comprising:

a vehicle movable along the pair of rails and having a frame overlying a portion thereof, the frame defining an anchor load station for receiving manually loaded anchors from an individual operating the vehicle;

a head assembly movably mounted on the frame for vertical movement toward and away from a tie;

first transport means for moving an anchor from the anchor load station vertically downwardly without vertically moving the head assembly to an anchor transfer station;

second transport means for moving an anchor from the anchor transfer station into a position for adjustment on the rail;

means at said transfer station for transferring anchors from the first transport means to the second transport means;

adjuster means for positioning the anchor along the rail and into abutment with the tie; and a rotary applicator for resiliently placing a positioned anchor into positive engagement with the rail.

7. The apparatus defined in claim 6 in which the adjuster means comprises a pair of spaced apart adjuster plates movably connected to the head assembly for embracing a pair of anchors transported therebetween, and driving means interconnecting the plates for providing a force sufficient to move the plates relatively towards each other and thereby move the anchors into abutting relation with opposite vertical faces of a tie.

8. The apparatus defined in claim 6 including stabilizing means for embracing a portion of a rail to maintain the lateral position of the apparatus on the pair of rails when a positioned anchor is resiliently placed into positive engagement with a rail.

9. The apparatus defined in claim 6 including a leveling means on the frame for maintaining a substantially horizontal orientation of the head assembly during vertical movement toward and away from the tie.

10. The apparatus defined in claim 6 including a centering means on the frame for engaging the head assembly to facilitate the maintaining of a centered position thereof.

11. The apparatus defined in claim 6 in which the means for transferring anchors from the first transport means to the second transport means comprise a plate powered for movement along the first transport means and into contact with an anchor supported thereon whereby the anchor is forced from the first transport means into receivable engagement with the second transport means.

12. An apparatus for applying anchors on at least one of a pair of tie-mounted parallel spaced rails, said apparatus comprising:

a vehicle movable along the pair of rails and having a fame overlying a portion thereof, the frame defining an anchor load station for receiving manually loaded anchors from an individual operating the vehicle;

a head assembly movably mounted on the frame for vertical movement toward and away from a tie;

first transport means for moving an anchor from the anchor load station to an anchor transfer station;

second transport means for moving an anchor from the anchor transfer station into a position for adjustment on the rail;

means at said transfer station for transferring anchors from the first transport means to the second transport means;

adjuster means for positioning the anchor along the rail and into abutment with the tie; and a rotary applicator for resiliently placing a positioned anchor into positive engagement with the rail, said adjuster means comprising a pair of spaced apart adjuster plates movably connected to the head assembly for embracing a pair of anchors transported therebetween, and driving means interconnecting the plates for providing a force sufficient to move the plates relatively towards each other and thereby move the anchors into abutting relation with opposite vertical faces of a tie, the second transport means comprising an articulated arm rotatably connected to one of the adjuster plates and a first actuator means interconnecting the adjuster plate and the arm for rotating the arm relative to the adjuster plate to move the anchor from the transfer station to the adjusting station.

13. The apparatus defined in claim 12 in which the articulated arm comprises a pair of pivotally interconnected links with one of the links being rotatably connected to one of the adjuster plates and a second actuator means interconnecting a first link of the pair and a second link the pair for rotating the second link relative to the first link to the other of the links to resiliently place a positioned anchor into positive engagement with the rail.

14. The apparatus defined in claim 13 including force reaction links releasably interconnecting an adjuster plate and a first link of the pair of links defining the pivoting arm to absorb reaction forces imparted by the resilient placing of a positioned anchor into positive engagement with the rail.

15. An apparatus for applying anchors on at least one of a pair of tie-mounted parallel spaced rails, said apparatus comprising:

a vehicle movable along the pair of rails and having a fame overlying a portion thereof, the frame defining an anchor load station for receiving manually loaded anchors from an individual operating the vehicle;

a head assembly movably mounted on the frame for vertical movement toward and away from a tie;

first transport means for moving an anchor from the anchor load station to an anchor transfer station;

second transport means for moving an anchor from the anchor transfer station into a position for adjustment on the rail;

means at said transfer station for transferring anchors from the first transport means to the second transport means;

adjuster means for positioning the anchor along the rail and into abutment with the tie;

a rotary applicator for resiliently placing a positioned anchor into positive engagement with the rail;

stabilizing means for embracing a portion of a rail to maintain the lateral position of the apparatus on the pair of rails with a positioned anchor resiliently placed into positive engagement with a rail, the stabilizing means having anti-friction elements for embracing a portion of a rail to maintain the lateral position of the apparatus on the pair of rails with a positioned anchor resiliently placed into positive engagement with a rail.

16. An apparatus for applying anchors on one or a pair of tie-mounted parallel spaced rails, comprising:

a vehicle movable along the pair of rails and having a frame overlying a portion thereof;

a head assembly movably mounted on the frame for vertical movement toward and away from a tie; and an articulated applicator arm rotatably mounted on the head assembly and having a pair of pivotally connected links, with a first actuator means interconnecting a first link with the head assembly and a second actuator means for rotating a second one of the links relative to the first link to resiliently place an anchor carried thereby into positive engagement with the rail.

17. In an apparatus for placing anchors into abutting relationship with opposite vertical faces of a rail-mounting tie and into positive engagement with a rail, the apparatus including a vehicle movable along a pair of rails and a frame overlying a portion of the rails, a head assembly movably mounted on the frame for vertical movement toward and away from the tie, and adjuster means for moving a pair of anchors oppositely along the rail and into abutment with the tie, an anchor applicator assembly comprising:

an articulated arm having a proximal end pivotally engaging the head assembly and a distal end with an anchor-receiving recess, the arm having a pair of pivotally interconnected links, with a first actuator means interconnecting the head assembly and the first link for rotating the first link relative to the head assembly to transport an anchor received in the recess at the distal end thereof to an adjustment station, and a second actuator means interconnecting the first link and the second link for rotating the second link relative to the first link to place an anchor received in the recess at the distal end of the arm into positive engagement with a rail.

18. The anchor applicator assembly defined in claim 17 including force reaction links releasably interconnecting a first link of the pair of links with the adjuster means to absorb reaction forces imparted by the rotation of the second link relative to the first link to resiliently place a positioned anchor into positive engagement with the rail.

19. An apparatus for applying anchors on a tie-mounted rail, comprising:

a frame;

a head assembly movably mounted on the frame for vertical movement toward and away from the tie; and an applicator arm having a pair of pivotally interconnected links, with a first actuator means interconnecting one of the links and the head assembly for rotating the arm to transport an anchor supported thereon toward the rail, and a second actuator means interconnecting the one link with another link for rotating the other link relative to the one link for resiliently placing an anchor into positive engagement with the rail.

20. An apparatus for applying an anchor to a tie-mounted rail, said apparatus comprising:

a frame defining an anchor load station for receiving anchors;

a head assembly movably mounted on the frame for vertical movement toward and away from a tie;

first transport means for moving an anchor from the anchor load station to an anchor transfer station;

second transport means for moving an anchor from the anchor transfer station into a position for adjustment on the rail;

adjuster means for moving the anchor along the rail and into abutment with the tie; and an applicator assembly for placing a positioned anchor into positive engagement with the rail, the second transport means comprising an articulated arm rotatably connected to the head assembly and a first actuator means interconnecting the adjuster plate and the arm for rotating the arm relative to the head assembly to move the anchor from the transfer station to the position for adjustment on the rail.

21. An apparatus for applying an anchor to a tie-mounted rail, comprising:

a frame;

a head assembly movably mounted on the frame for vertical movement toward and away from a tie;

delivery means for transferring an anchor into a position for adjustment on the rail, the delivery means including first transport means for moving an anchor from a load station to a transfer station and a second transport means for moving the anchor from the transfer station to an adjusting station, the first transport means having a circuitously driven chain for continuously transporting pairs of anchors sequentially from the load station to the transfer station and upon transfer to the second transport means return to the load station;

adjuster means for moving the anchor along the rail and into abutment with the tie; and an applicator assembly for placing a positioned anchor into positive engagement with the rail.

22. The apparatus defined in claim 21 including a carrier guided for movement along an inclined track and adapted for releasable engagement with an anchor, the carrier being driven for circuitous movement by the chain to move the anchor between the load station and the transfer station.

23. The apparatus defined in claim 21 in which the second transport means has retention means for preventing disturbance of anchors transferred thereto when the first transport means returns to the load station.

24. An apparatus for applying anchors on at least one of a pair of tie-mounted parallel spaced rails, comprising:

a vehicle movable along the pair of rails and having a frame overlying a portion thereof;

a head assembly movably mounted on the frame for vertical movement toward and away from a tie;

delivery means for transferring an anchor into a position for adjustment on the rail;

adjuster means for positioning the anchor along the rail and into abutment with the tie;

a rotary applicator for resiliently placing a positioned anchor into positive engagement with the rail; and stabilizing means having anti-friction elements for embracing a portion of the rail to maintain the lateral position of the apparatus on the pair of rails when a positioned anchor is resiliently placed into positive engagement with a rail.

* * * * *